US006575504B2

(12) United States Patent
Roatis et al.

(10) Patent No.: US 6,575,504 B2
(45) **Date of Patent: *Jun. 10, 2003**

(54) BAYONET LOCKING SYSTEM AND METHOD FOR VENDING MACHINES AND THE LIKE

(75) Inventors: Calin Vasile Roatis, DesPlaines, IL (US); Gary L. Myers, Monee, IL (US)

(73) Assignee: TriTeq Lock and Security, L.L.C., Elk Grove, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/962,387

(22) Filed: Sep. 25, 2001

(65) Prior Publication Data

US 2002/0060457 A1 May 23, 2002

Related U.S. Application Data

(60) Provisional application No. 60/252,210, filed on Nov. 21, 2000.

(51) Int. Cl.[7] ..... E05C 3/06

(52) U.S. Cl. ..... 292/199; 292/201; 70/208

(58) Field of Search ..... 292/201, 99, 112, 292/160, 144, 142, DIG. 25, DIG. 49; 70/208, 257, 280–282, 278.7, 279.1

(56) References Cited

U.S. PATENT DOCUMENTS

| | | | | |
|---|---|---|---|---|
| 3,089,330 A | | 5/1963 | Kerr | |
| 3,550,412 A | | 12/1970 | Pitel et al. | |
| 4,167,104 A | * | 9/1979 | Bond | 70/208 |
| 4,355,830 A | * | 10/1982 | Rau, III | 292/144 |
| 4,552,001 A | | 11/1985 | Roop | |
| 4,760,721 A | | 8/1988 | Steinbach | |
| 4,899,561 A | | 2/1990 | Myers | |
| 4,993,247 A | | 2/1991 | Minemura | |
| 5,160,180 A | * | 11/1992 | Mlynarczyk | 292/251 |
| 5,548,982 A | | 8/1996 | Rawling | |
| 5,813,257 A | * | 9/1998 | Claghorn et al. | 292/201 |
| 5,823,027 A | | 10/1998 | Glick et al. | |
| 5,921,119 A | * | 7/1999 | Myers et al. | 292/336.3 |
| 6,005,487 A | | 12/1999 | Hyatt, Jr. et al. | |
| 6,068,305 A | * | 5/2000 | Myers et al. | 292/201 |
| 6,068,487 A | | 5/2000 | Dionne | |
| 6,345,522 B1 | * | 2/2002 | Stillwagon et al. | 292/341.16 |
| 6,360,573 B1 | * | 3/2002 | Ming-Chih | 70/256 |
| 6,370,928 B1 | * | 4/2002 | Chies et al. | 70/278.2 |
| 6,406,071 B1 | * | 6/2002 | LaViola et al. | 16/441 |

FOREIGN PATENT DOCUMENTS

| | | | |
|---|---|---|---|
| JP | 02-91371 | * | 3/1990 |

* cited by examiner

*Primary Examiner*—Robert J. Sandy
*Assistant Examiner*—André L. Jackson
(74) *Attorney, Agent, or Firm*—Leydig, Voit & Mayer, Ltd.

(57) ABSTRACT

An electro-mechanical locking system for vending machine doors and the like having a function that facilitates securing a movable gasketed door and effectively seals the movable door wherein a lock assembly comprises a motor driven device that is attached to one of the movable door assembly or cabinet body and has a rotatable and translatable shaft with a bayonet end having an arrow shape end that engages a slotted stationary device that is generally located in the cabinet body. Driving members cause the translational and rotational movement of the bayonet end and are configured to move in a curvilinear or sinusoidal path so there is a smooth transition and some rotation along with translational movement.

9 Claims, 11 Drawing Sheets

BAYONET LOCKING SYSTEM AND METHOD FOR VENDING MACHINES AND THE LIKE

CROSS-REFERENCE TO RELATED PATENT APPLICATIONS

This patent application claims the benefit of U.S. Provisional Patent Application No. 60/252,210, filed Nov. 21, 2000 and it is a continuation-in-part thereof.

FIELD OF THE INVENTION

This invention relates generally to locking devices and, more particularly, locking devices for vending machines and the like.

BACKGROUND OF THE INVENTION

Pop out and cam out lock assemblies and the like are well known art. Such assemblies are commonly used for example to prevent unauthorized access to vending machines. Vending machines being further defined as devices such as refrigerated soft drink machines, food (snack) machines, candy machines, coin changers, mass transit collection systems, storage boxes, and the like. These conventional locking devices are so well defined that dimensional standards exist for the vending industry. Several patents have been issued for modifications and improvements in the field of these devices. For example, T handles or pop-out handle devices are well known in the industry; see, U.S. Pat. Nos. 3,089,330 (Kerr), 3,550,412 (Pitel et al.), 4,552,001 (Roop), 4,760,721 (Steinbach), 4,899,561 (Myers), and 5,548,982 (Rawling). The pop-out assemblies and the like also facilitate the sealing of the gasket on many of the vending machines described above. This sealing action is derived typically from a screw type action of the threaded shaft of the pop-out handle as it threads itself into the stationary device in the cabinet structure. The force to tighten the door comes from a multiplication of hand forces that are exerted on the various designed members of the Pop-out lock. Therefore, the amount of force is very subjective and is cause for improper sealing of the vending machine. It is desirable in the industry to have the door locked and properly sealed.

The pop-out handle and its summary of inventions with improvements still present a clear security risk. The pop-out handle itself must be located on an exterior surface of the vending machine. The handle must be located on the exterior to allow for lock access with a variety of keys and to allow the operator to turn the screw tight in an attempt to seal the door. This allows for a variety of attack methods. Efforts to prevent unauthorized entry on machines with Pop-out handles have included adding secondary locking devices such as padlocks with hasps to effectively cover the handle or manufacturing the handle out of exotic alloys or adding steel hardened plates and the like. Each invention whilst improving the security of the basic handle still keeps the basic handle in its original form and utility.

The conventional pop-out handle lock assemblies include two generally T-shaped components, which cooperated to secure a movable door of a typical vending machine. More specifically, such Pop-out assemblies typically comprise of a generally T shaped housing mounted to the movable door and generally T shaped lock housing handle which is received by and nested within the generally T shaped housing. The T shaped lock handle housing has an integral handle and shell with additional provisions for a stem portion that is generally threaded. The shell is designed to facilitate the mounting of a cylindrical lock assembly. The two T shaped members are disposed so as to be secured by a lock stud that protrudes through both members. The T shaped lock handle housing includes a slot that allows the stem to disengage when the handle is pushed rearwards.

The movable door may be opened by rotating the lock key and causing the lock stud to retract. Further this action by retracting the T shaped lock handle housing allowing it to slide longitudinally along its axis until it engages the end of the stem. After the stem has engaged the T shaped lock handle housing the operator is free to rotate the housing. This rotation causes the screw to extend and disengage from the stationary device attached to the cabinet. After disengaging the movable door can then be opened.

By reversing the above process the door is secured with the following exception. The lock stud may or may not be spring tensioned to allow the T shaped handle housing to be pushed back without further action from the key or lock.

Because goods and currency are customarily stored within the cabinet structure there is a greater need for higher levels of security.

Prior art such as Myers U.S. Pat. No. 6,068,487 does provide means by which to latch and effectively pull in or seal the movable door and it does provide a reasonable level of security but it is severely restricted in applications because of complexity and cost. Major changes are required to allow fitment into vending machines and the like. Claghorn U.S. Pat. Nos. 5,813,257 and Glick 5,823.027 still use the T handle embodiment. Hyatt U.S. Pat. No. 6,005,487 provides extensive encryption and an electronic key with battery power source independent from the vending machine.

The present invention provides such a locking device and method of locking that is not intrusive into the vending machine, capable of being key-less electronically operated, and enables obtaining a reliable, secure seal for vending machine doors having gaskets. These and other advantages of the invention, as well as additional inventive features, will be apparent from the description of the invention provided herein.

BRIEF SUMMARY OF THE INVENTION

The invention provides an optionally key-less electronically operated bayonet locking device and method of operating the same wherein a rotatable and translatable bayonet device or means having an arrow shaped end is carried by respective ones of the vending machine door and cabinet and a stationary slotted receiving member carried by the other one of the respective door and cabinet. The bayonet device arrow shaped end enters the slottted receiving member and then rotates to secure the door and the end translates longitudinally pull in the door for effectively sealing a door gasket on the machine. The locking device is constructed so as to enable that rotation at least in the transitional phase with longitudinal translation of the arrow shaped end occurs together.

OBJECTS OF THE INVENTION

Accordingly, a primary object of the invention is provide a bayonet locking device for a vending machine or the like that can remove the point of attack from the outside of the vending machine, therefore, giving a vending machine equipped with this device a higher level of security.

A secondary objective is to facilitate the proper sealing of the movable door.

As a related object of the invention, the locking device provides a reduction in manual effort for operation, which in turn will reduce the potential for bodily injuries.

Also related to the sealing action is the ancillary improvement objective for keeping the temperature inside the vending machine more consistent and aiding in reducing energy consumption as well as reducing mechanical compressor failures. Related to compressor failures is the possible exposure of the environment to harmful ozone depleting gases.

An additional object of the invention is to allow for a variety of different access disciplines such as electrically controlled or electronically controlled, and also enabling use of a variety of commercially available communication mediums to open the movable door. Communication mediums such as IRDA, RFID, RF, IR, Magnetic cards, Smart Cards, Keypads, Cellular phone, Pager networks, Dallas ibutton, merely by way of example, can be used with the locking device of the present invention.

Another further object is to allow the lock to be controlled in such a manner as to indicate which key or access device was used to access the vending machine.

Also provided is the ability to couple with the vending machine electric supply in such a manner as to allow the vending machine to operate within prescribed wattage limitations.

Also embodied into the objectives is the ability to maintain the door seal for extended periods of time and not have cause to cease up or freeze the mechanism.

BRIEF DESCRIPTION OF THE DRAWINGS

In the drawings, whereas similar reference numerals denote similar elements throughout the several views.

Figure 1:
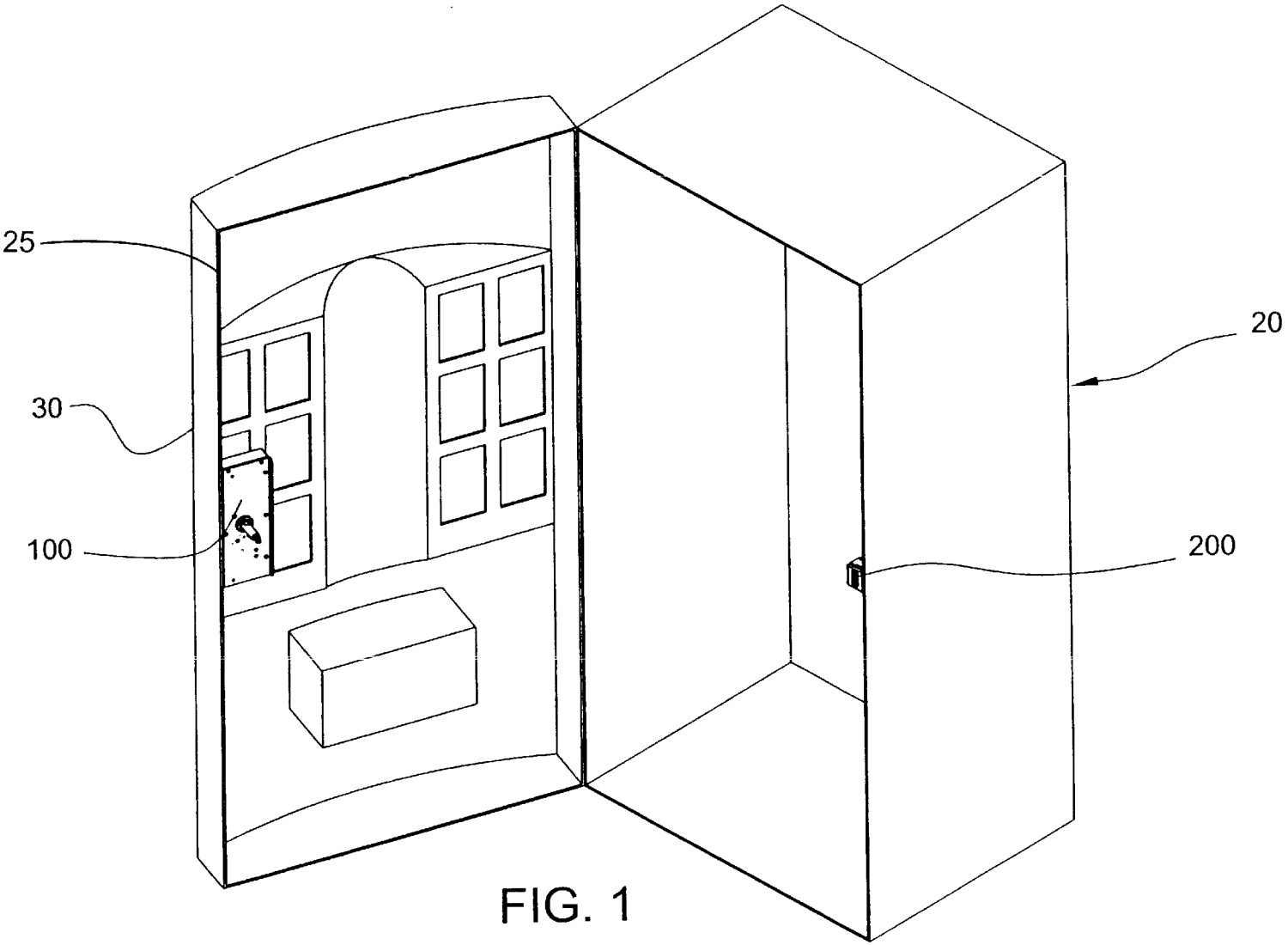
FIG. 1 is a perspective view of a typical vending machine having the lock mounted thereto and incorporating the basic elements of the system.

While the present invention will be described and disclosed in connection with certain preferred embodiments and procedures, it is not intended to limit the invention to the specific embodiments. On the contrary, it is intended to cover all such alternatives, modifications, and equivalents that fall within the spirit and scope of the present invention as defined by the appended claims.

DETAILED DESCRIPTION OF THE INVENTION

The above objects are accomplished by providing a locking device that can be totally housed inside the cabinet and movable door structure of vending machines. The locking system is composed of two mechanical devices that interact using electronics to control the interaction that allows the vending machine to be a highly secure device.

The first part of the mechanical lock consists of central cylindrical housing, a rotatable shaft, and a ramped gear housing, motor drive and cross pin with rollers. The second part of the mechanical lock is the stationary device that consists of method for attaching it to the cabinet as well as a slotted plate that receives the rotatable shaft while the door is closing.

The locking action begins by moving the arrow shaped end of the rotatable shaft into the slotted plate on the stationary device. This action causes a movable plate that is located in the stationary device to change the state of an electrical switch. This sends a signal to a control device and activates a gear motor. The gear motor rotates the ramped gear housing and causes the pin to react with a radially slot on the central cylindrical housing. The rotatable shaft is nested inside the central housing and the pin passes through a slot that is machined parallel through the shaft. The pin is nested in such a manner as to facilitate two bearing surfaces on either side of the central cylindrical housing. As the pin moves it follows the contours of the slot located in the central cylindrical housing. The slot is curved so to allow a smooth transition from a radial motion to a parallel motion. The parallel motion causes the pin to move up the ramps located inside the ramped gear housing. This action causes the rotatable shaft to draw into the central cylindrical housing. Rollers are provided on the pin to reduce friction. The curvilinear shape of the slot in the central cylindrical housing keeps the rollers from jamming as the action transitions from radial to linear motion and provides a somewhat sinusoidal path of movement. Steel ramps are nested in the ramped gear housing. These ramps provide high wear surfaces for the pin rollers and prevents plastic failure of the ramped gear housing. The steel ramps are curved and are effectively are standing on end inside the ramped gear housing. These ramps transfer all on the compressive forces of the pin rollers to the mounting plate surface of the lock. An additional wear plate is located between the ramped gear housing and mounting plate surface of the lock. The motion of the pin as it moves up the ramp is transferred from the ramp surface to the central cylindrical housing slot, then the pin follows the slot pushing on a screw that is located in the back of the rotatable shaft. By adjusting this screw in and out of the rotatable shaft the relative position of the rotatable shaft is changed. The length of the motion is controlled by the height of the ramp surfaces. The gear motor stops when it is signaled by either an electrical switch that is located on the ramped gear housing or excessive current (wattage). The function of the rotatable shaft is further defined by using a second sensing switch on the ramped gear housing. This sensing switch detects the rotatable shaft as it begins its rotation. If the movable door is allowed to open before the rotatable shaft has rotated far enough to cause the arrow to be positioned behind the slotted plate on the stationary device the rotatable shaft will return to the position where the arrow can be removed by opening the movable door on the vending machine.

To unlock the door, the motor receives a signal to energize. The motor turns the opposite direction that was used to lock the movable door. The ramped gear housing rotates and the pin with rollers follows the ramp. The pin travels along the parallel surface. This action causes the rotatable shaft to extend itself. This action releases the sealing. The pin continues to follow the parallel slot until it transitions to the sinusoidal shape and begins its radial movement. This radial movement causes the rotatable shaft to turn. The turning action is stopped after the pin has run out of ramp surface or the motor turns off. There is a switch that monitors the ramped gear housing position.

The stationary housing on the cabinet side of the vending machine can have its slotted plate either orientated vertically or horizontally when it is allowed to receive the arrow of the rotatable shaft. The vertical shape is desirable where the movable vending door is allowed to sag over time. This sagging will have cause to make the horizontal slotted plate not functional. The vertical design also facilitates manufacturing tolerances for the movable plate. The horizontal slotted stationary device movable plate is subject to unobtainable manufacturing tolerances.

The third item of the locking system is considered to be the logic required to operate the gear motor.

The object of access medium is defined as it is embedded into the logic system above. The access mediums are generally commercially available for integration into the locking system.

Referring now to the drawings, there is shown in FIG. 1 a typical vending machine 10 having a stationary cabinet 20 and a movable door 30 hinged and attached thereto. As it is customary in the art, the cabinet 20 includes a product compartment chamber (not detailed) where products to be vended (sold) are stored. In addition, the movable door 30 includes provisions for the collection and storage of money collected by the sales of products contained within the vending machine.

The specified locking system referenced by numeral 100 is shown in FIG. 1, and as being attached to the movable door 30 using common commercial fasteners. The stationary device is referenced by numeral 200 is shown in FIG. 1. The stationary device 200 is fastened to the cabinet 20 also using common commercial fasteners. The location of the locking system in the movable door 30 is generally opposite the hinged side of the movable door 30 and is generally centrally located on the vertical plane.

Figure 2:
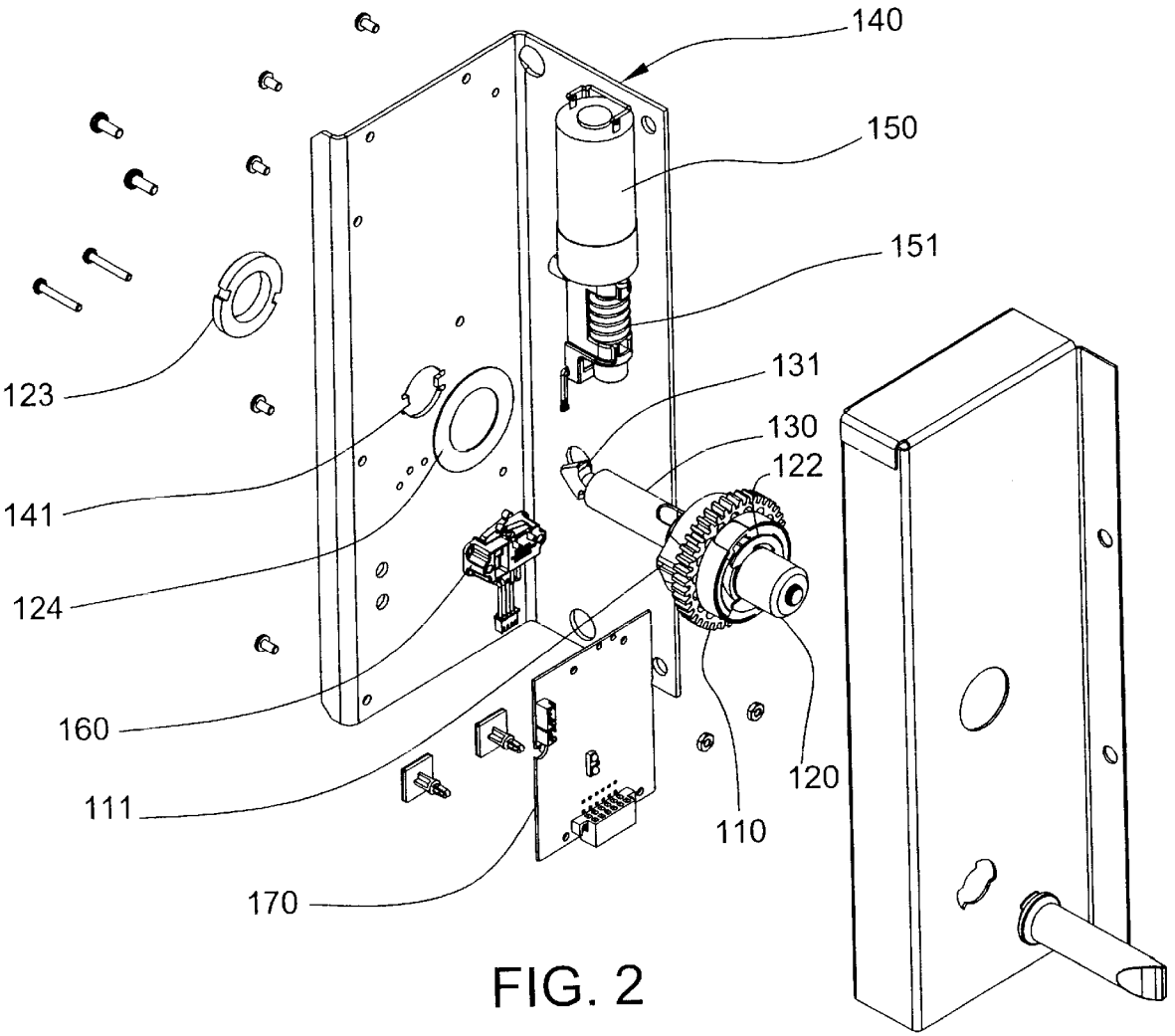
FIG. 2 is an exploded perspective view of the lock assembly depicted in FIG. 1.
Figure 6:
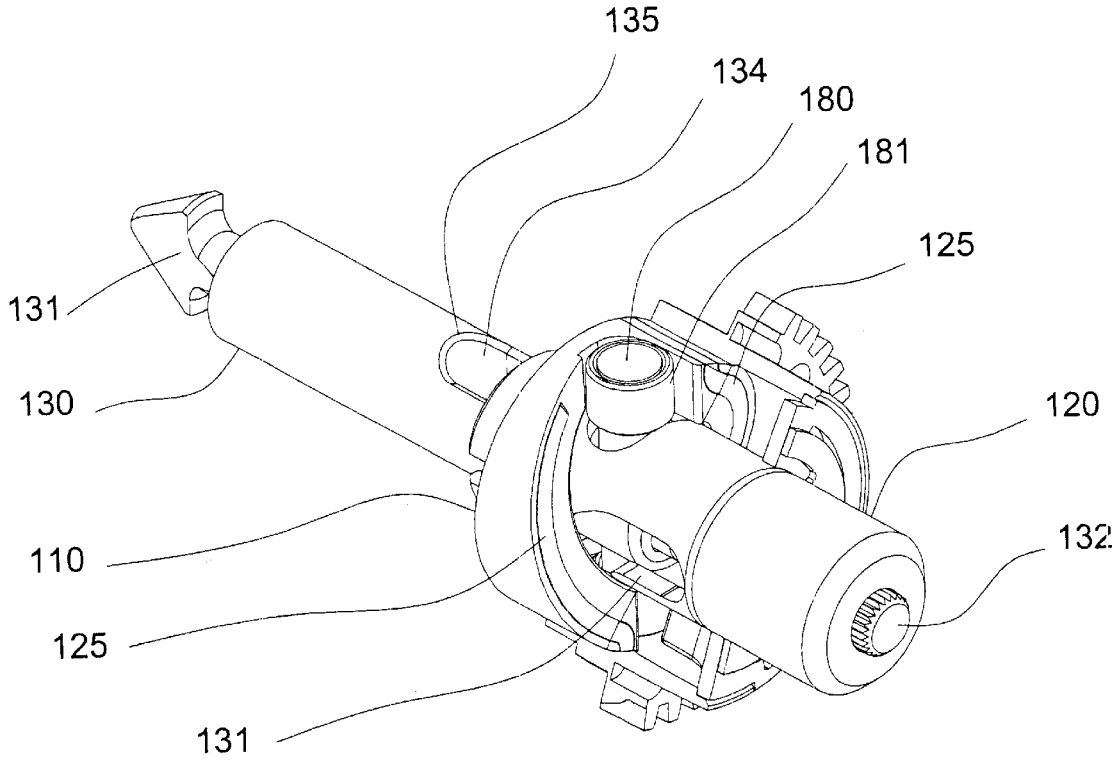
FIG. 6 is a partial cross sectional view depicting relative position of internal lock components in the open state. This figure is directly respective to FIG. 4.
Figure 7:
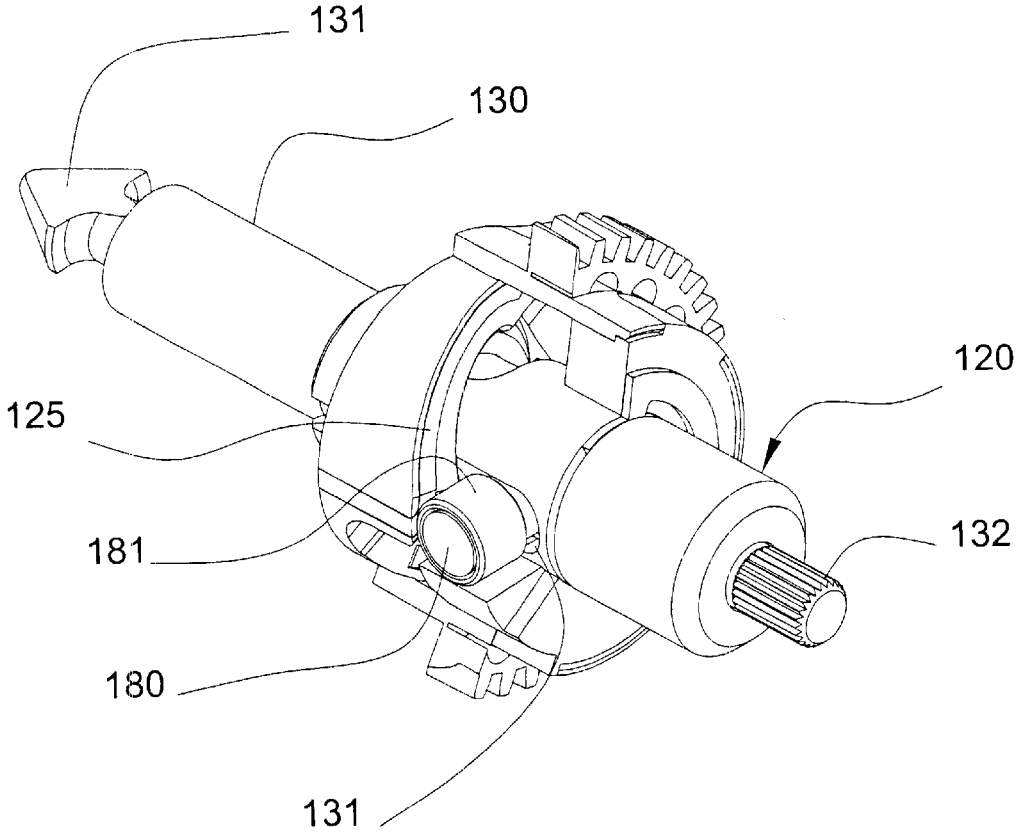
FIG. 7 is a partial cross section view depicting relative position of internal lock components in the locked state. This figure is directly respective to FIG. 5.

In the second illustrated embodiment FIG. 2 the ramped gear housing 110 is shown assembled to central cylindrical housing 120. It is retained in place between a snap ring 122 and a larger diameter of the central cylindrical housing 120 a rear ramped cover 121 provides a surface for the snap ring 122 to rest on. The rotatable shaft 130 is shown with the bayonet end having an arrow-shaped end section/portion 131 of the rotatable shaft in the vertical position. The central cylindrical housing 120 is fastened to the mounting system 140 with a threaded fastener 123 and key slots 141 provided in the mounting system 140. The central cylindrical housing 120 is stationary in the mounting system 140. In FIG. 6 two steel ramp sections 125 rest on the washer 124. The adjuster screw 132 is threaded into the rotatable shaft 130 and passes through a hole at the rear of the central cylindrical housing 120. The gear motor drive 150 turns the worm gear 151 and that in turn rotates the ramped gear housing 110. Two switches 160 provide electrical feed back to the logic board 170. There are surfaces 111 on the ramped gear housing 110 that activate the switches as the ramped gear housing 110 rotates.

Figure 3:
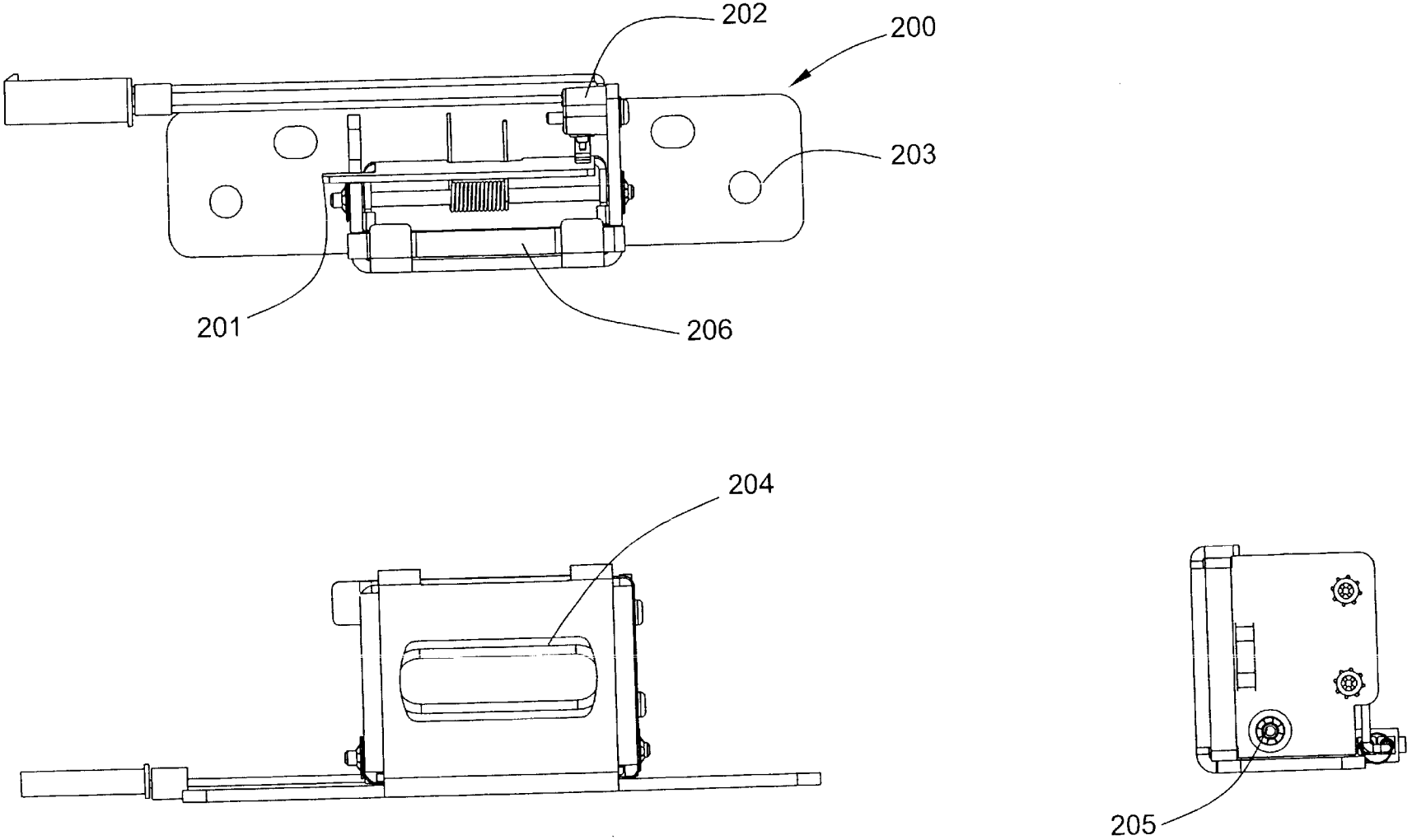
FIG. 3 are three assembly views of the stationary device that is mounted in the cabinet depicted in FIG. 1.
Figure 4:
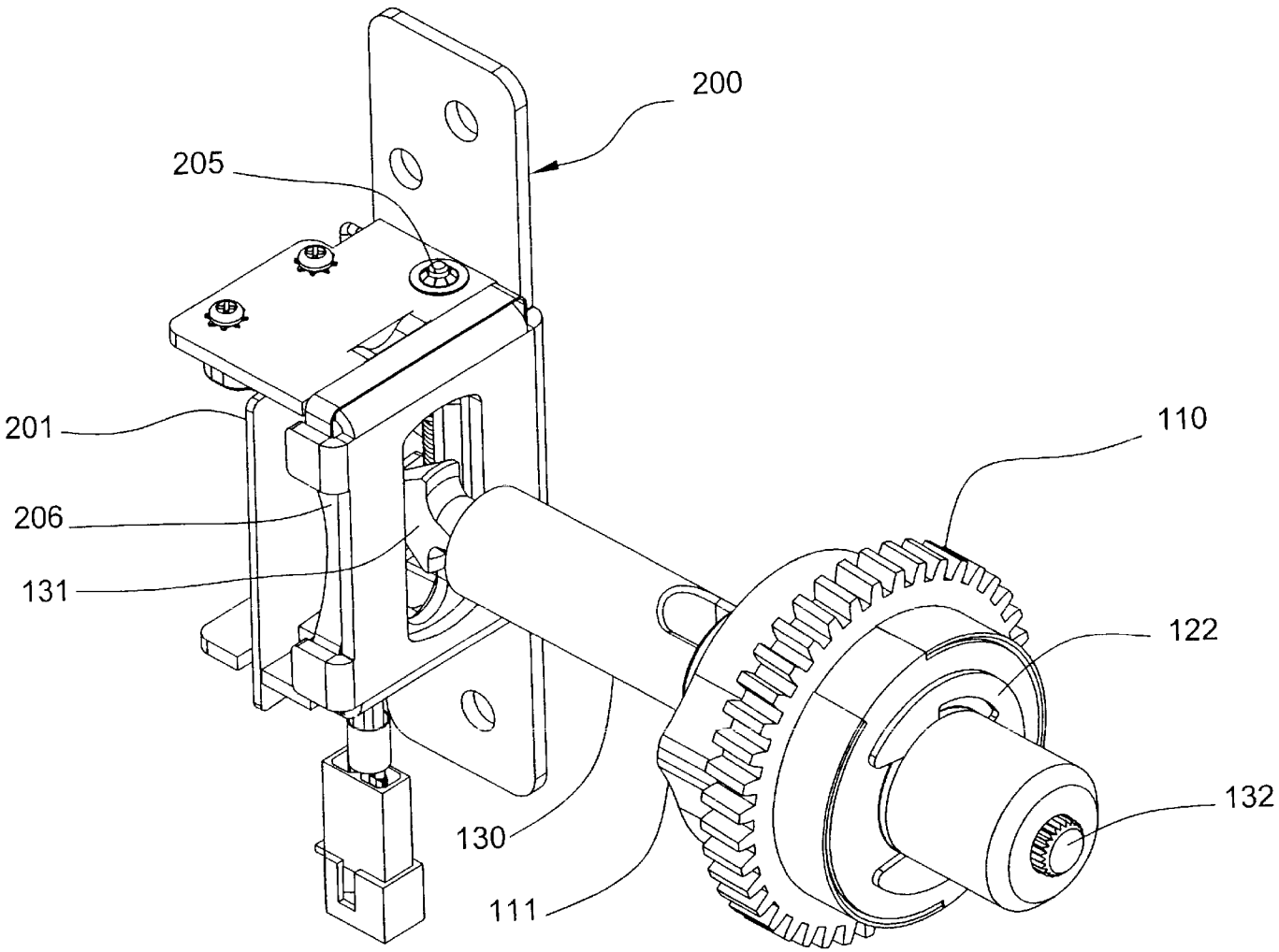
FIG. 4 is perspective assembly view of the lock and stationary device, as the lock would be considered open. This figure is directly respective to FIG. 6.

The stationary receiver unit 200 FIG. 3 is mounted into the stationary cabinet 20 as shown in FIG. 1 using the holes 203. The slotted plate 204 receives the bayonet end arrow section 131 as shown in FIG. 4. A moveable plate 201 is pushed rearward by the arrow section 131 which causes the movable plate 201 to rotate about the axle 205 and activates the switch 202 activating the gear motor 150 as shown in FIG. 2. A flat spring 206 that is nested in both sides of the receiver unit having two curved shapes allows the slotted plate 204 to move horizontally both directions. After the arrow section 131 is removed from the stationary receiver unit 200, the flat spring will reposition the slotted plate 204 about its original centerline position as it relates to the stationary receiver 200. This movement allows for horizontal manufacturing tolerances for both the cabinet 20 and the door 30 as the lock 100 and the stationary receiver 200 are mounted. The vertical slot in the slotted plate 204 allows for vertical tolerances.

Figure 5:
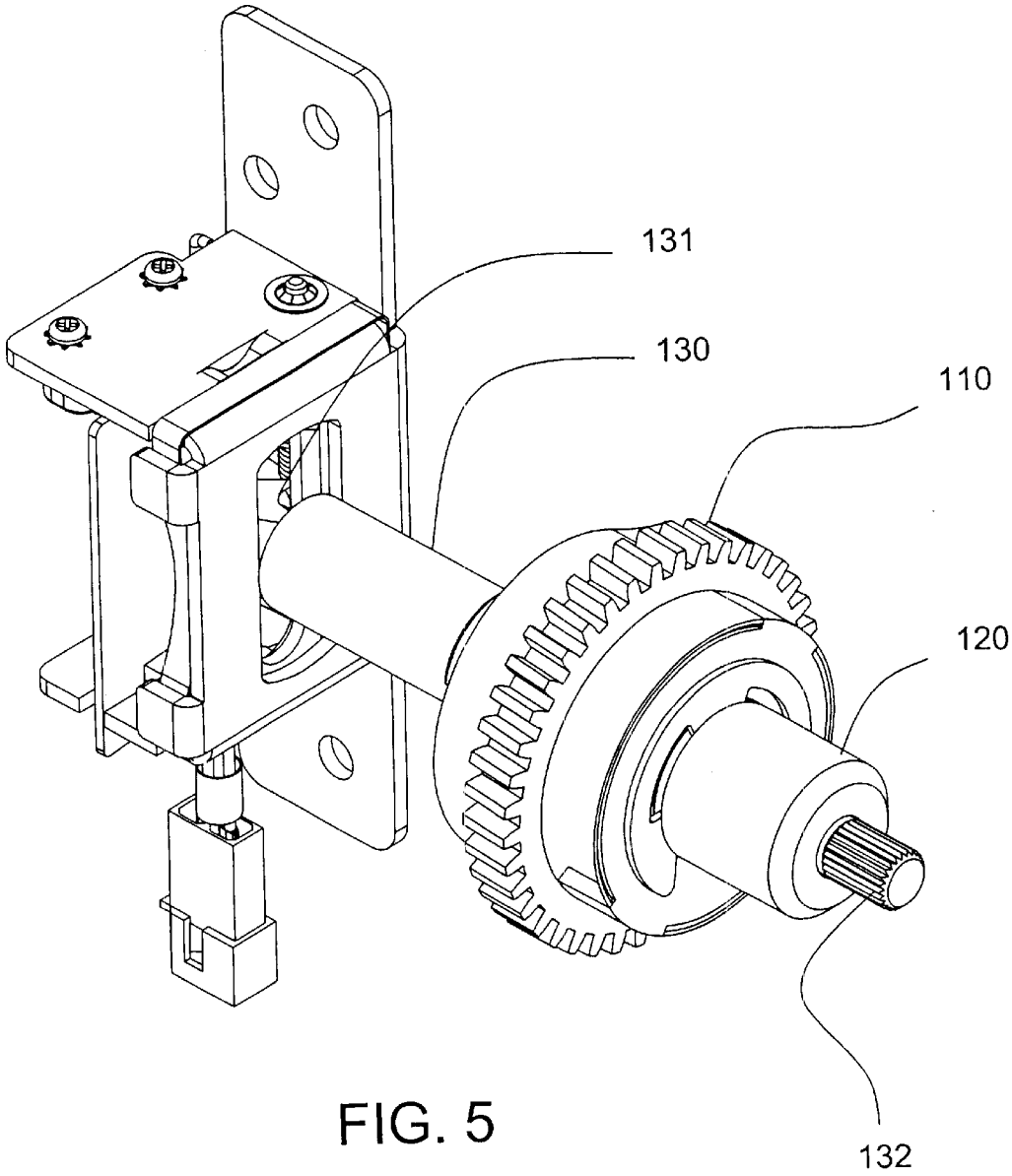
FIG. 5 is a perspective assembly view of the lock and stationary device, as the lock would be considered as locked. This figure is directly respective to FIG. 7.

In FIG. 5 the ramped gear housing 110 has continued to rotate causing the arrow section 131 of the rotatable shaft to move horizontally. The specific action will be detailed in subsequent sections. After the arrow section is horizontal the rotatable shaft 130 moves longitudinally into the central cylindrical housing 120.

Two rollers 181 are positioned about pin 180 in FIG. 6. Pin 180 passes through the central cylindrical housing 120 and a longitudinal slot in the rotatable shaft 130. The rollers 181 provide anti-friction and wear areas for the pin 180 and the steel ramps 125 as the unit operates.

Figure 11:
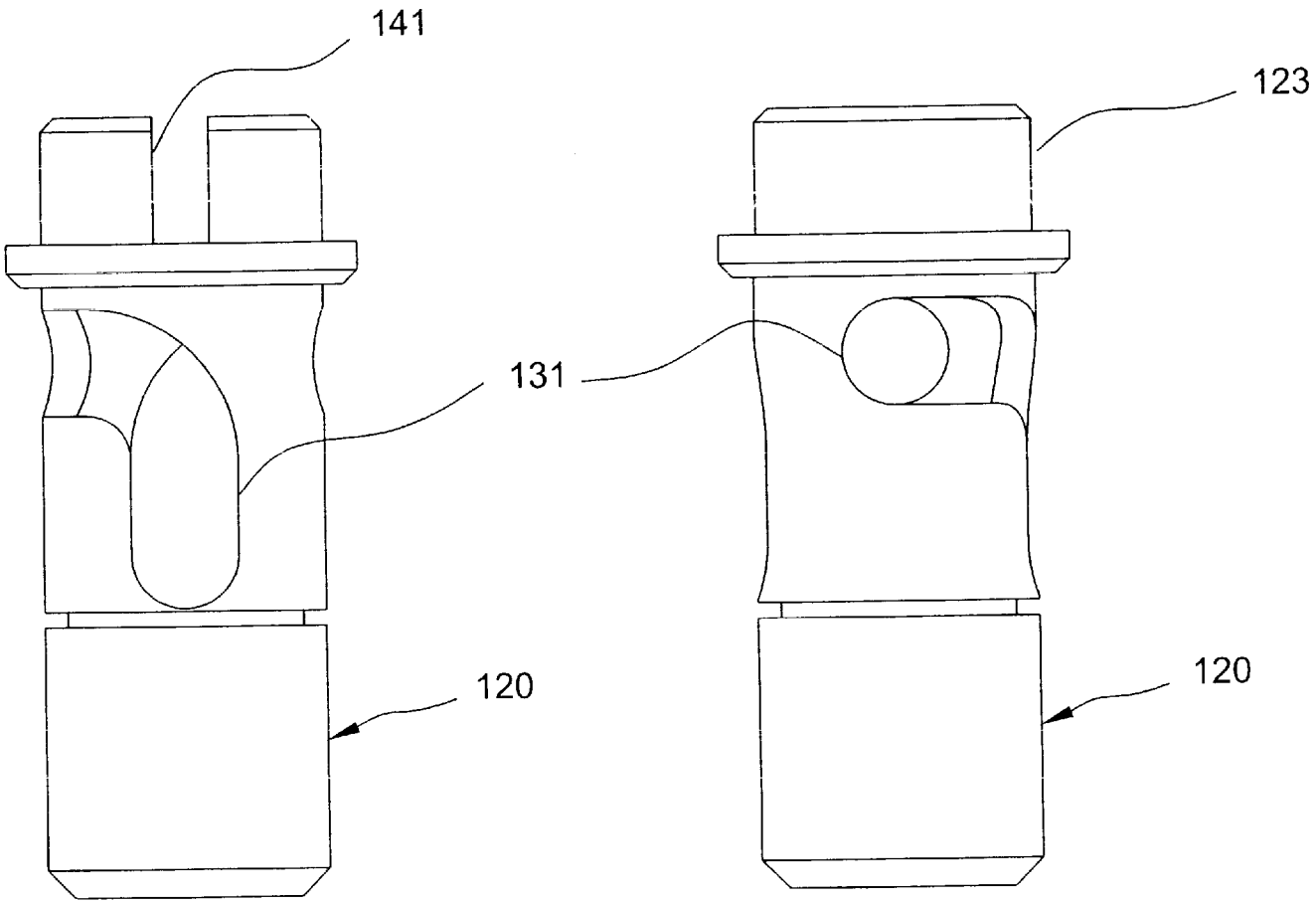
FIG. 11 is a plan view of the central cylindrical housing.

The pin 180 is positioned in an L shaped slot 131 FIG. 11 in the central cylindrical housing 120. In FIG. 6 it is shown resting in place at what is to be considered as the base of the L shape slot 131.

As the gear motor 150 activates it rotates the worm gear 151 this causes the ramped gear 110 to rotate. This in turn causes the pin 180 to move radially around the base of the L shape slot 131 in the cylindrical housing 120. This causes the arrow section 131 to rotate. As the ramped gear 110 continues to rotate the pin 180 makes contact with the side of the L shaped slot 131. The pin 180 then begins to move up the side of the L shaped slot 131 because the steel ramps 125 pushes the pin longitudinally. This longitudinal action was described earlier in this embodiment so as to describe its utility for this application. The shape of the L shaped slot 131 is conceived in such a manner as to prevent the rollers 181 from jamming as the pin 180 transitions from radial movement to a longitudinal direction.

The pin 180 actually facilitates the pushing action on the rotatable shaft 130 through the adjuster screw 132. While it is possible to have the pin 180 push on the end of the longitudinal slot in the rotatable shaft 130 it is desirable to allow for adjustment.

Figure 10:
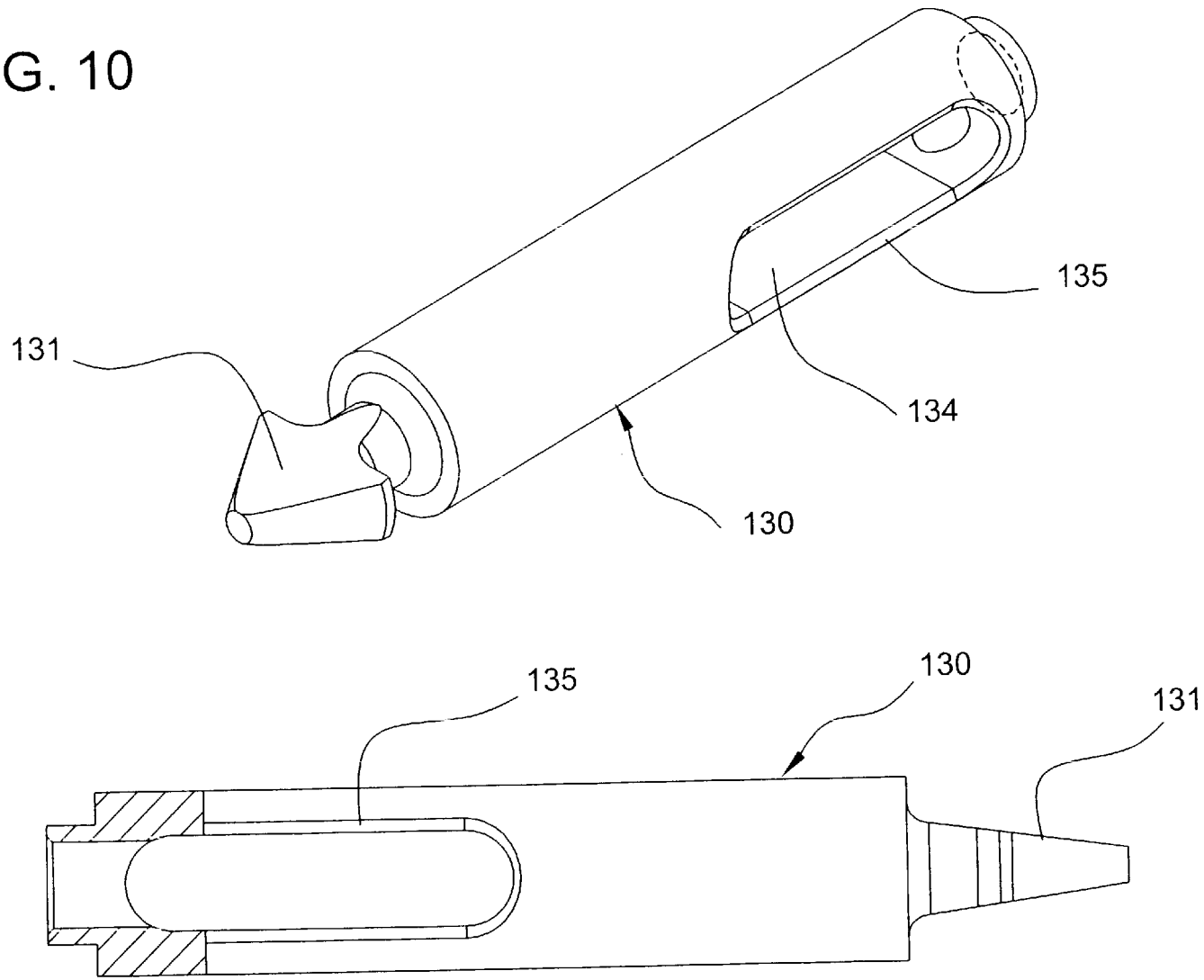
FIG. 10 is a perspective as well as a sectional view of the rotatable shaft

The longitudinal slot 134 in FIG. 6 and FIG. 10 is closed on both ends of the rotatable shaft. A threaded hole is provided through the centerline of the shaft intersecting the longitudinal slot 134 on the end opposite of the arrow portion 131 of the rotatable shaft. The longitudinal slot 134 provides the area for driving the rotation of the rotatable shaft. A chamfer 135 area is required to the prevent plastic deformation of the slotted area 134 of the outside diameter of the rotatable shaft 130 in reaching the inside bore diameter of the center cylindrical housing 120. A common compression spring (Not shown) is provided on the end of the rotatable shaft 120 and is housed inside the center cylindrical housing 120 at the end where the adjuster screw 132 is located. This spring provides a cushion effect when the mechanism is considered unlocked or open. That is to say when the arrow portion 131 of the rotatable shaft 130 is vertical.

Figure 8:
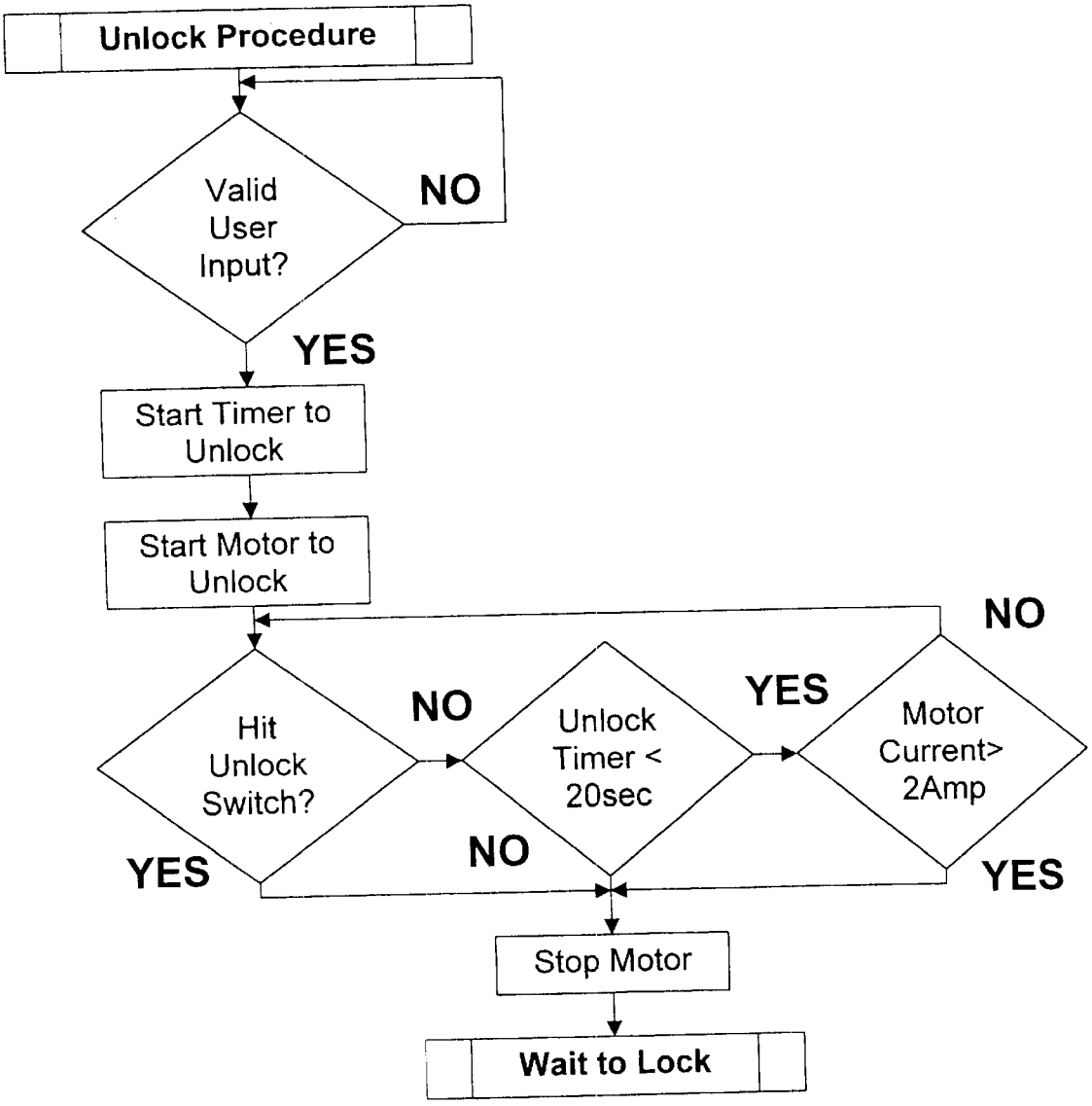
FIG. 8 and FIG. 9 defines one of many possible logic flow charts that allow the lock to open and close.
Figure 9:
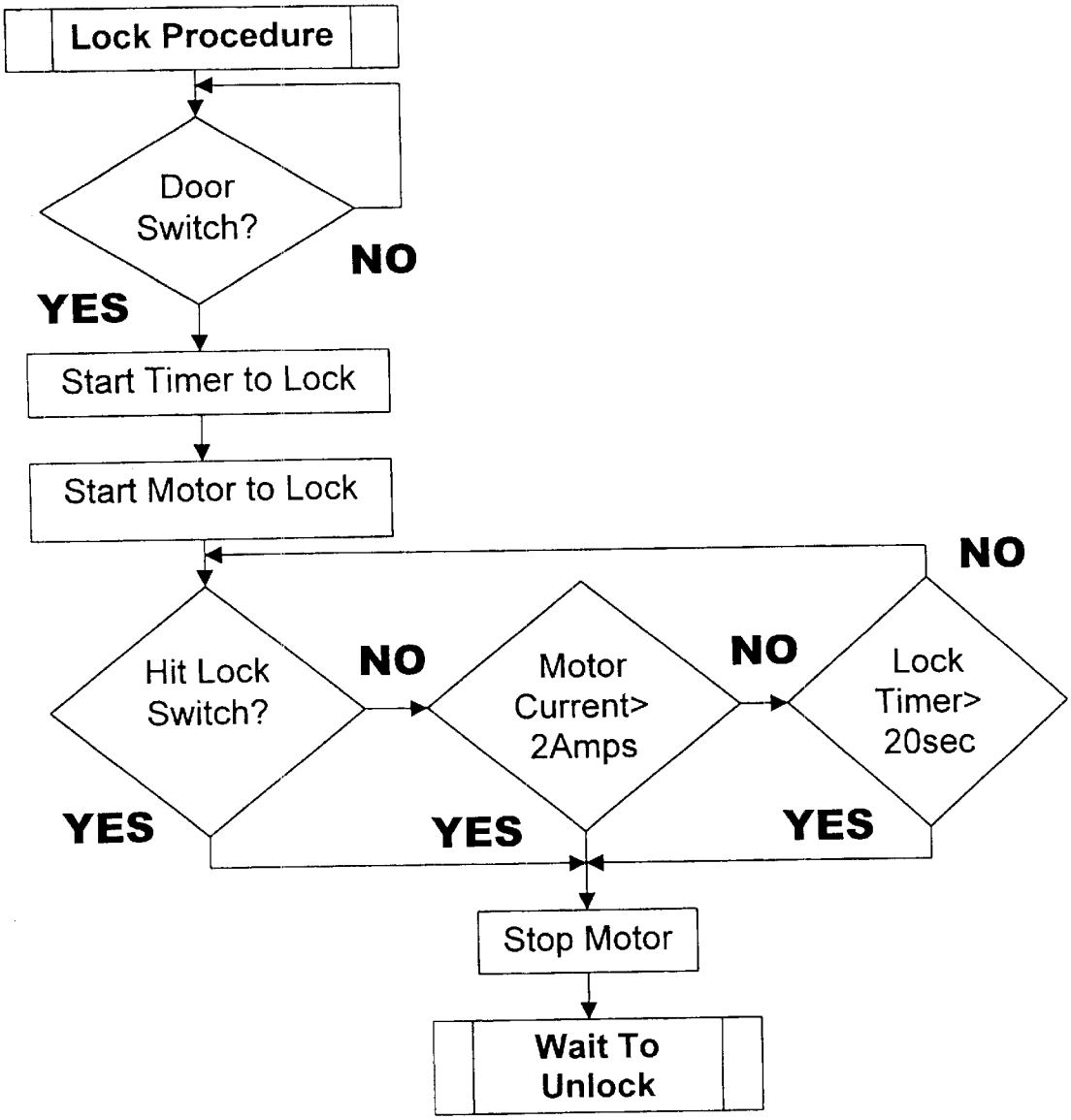

FIG. 8 Flow-chart indicate the unlock to locked event and vise versa. The control of the lock as it described in this embodiment may use a variety of methods to control it. While electronics (solid-state) type of controls are the current acceptable methodology the logic can be controlled with electromechanical relays. Communication signals to control the lock may derive from any number of means as described earlier.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A locking device for locking a movable door relative to a stationary body comprising in combination;

a bayonet locking means including an arrow shaped end carried by either said door or stationary body;

said bayonet locking means being longitudinally drivable for both translation and rotation relative to the door or stationary body by which it is carried;

a slotted receiving means stationarily carried by the other of said door or stationary body adapted to receive the arrow shaped end of said bayonet locking means;

an actuating means for advancing and retracting said bayonet locking means toward and away from said receiving means and rotating the arrow shaped end of the bayonet locking means to capture it within and release it from the slotted receiving means;

said actuating means including a drive means longitudinally retracting the bayonet locking means arrow shaped end to draw the locking device together with the receiving means and longitudinally advancing to release the bayonet locking means from the stationary receiving means; and said actuating means driving means moving said arrow shaped end of said bayonet locking means along a curvilinear path for causing both translational and rotation movement to occur together at least in the transitional phase of the arrow shaped end movement from translation to rotation and from rotation to translation.

2. A locking device as claimed in claim 1 wherein either said moveable door or stationary body carries a flexible peripheral gasket and said drawing of the bayonet locking device together with the receiving means causes said gasket to compressively seal the area between the door and body.

3. A locking device as claimed in claim 1 wherein said slotted receiving means is disposed with a vertically oriented slot.

4. A locking device as claimed in claim 1 wherein said bayonet locking means and said actuating means are carried with the door.

5. A locking device as claimed in claim 1 wherein said bayonet locking means is motor driven and said actuating means has a ramped housing cooperating with a slotted housing and pin follower carried by the bayonet locking means for providing the rotational and translational movements of the arrow shaped end of the bayonet lock.

6. A method of locking a door relative to a stationary cabinet wherein a compressible gasket is positioned between the door and cabinet comprising the steps of:

positioning an actuatable bayonet locking means having an arrow shaped end within said door or cabinet with said bayonet locking means capable of being driven with both rotational and translational movements relative to door or cabinet by which it is carried;

providing a slotted stationary receiving means on the other of said door and cabinet adapted to receive the arrow shaped end of said bayonet locking means;

driving the bayonet arrow shaped end longitudinally to retract and advance the bayonet locking means for respectively drawing the door and cabinet together and releasing the door from the cabinet;

and driving said arrow shaped end rotationally within the slotted receiving means while driving the arrow shaped end with at least some longitudinal driven movement during a portion of the rotational movement.

7. A method as claimed in claim 6 wherein the slotted receiving means is positioned with the slot vertically oriented.

8. The method as claimed in claim 6 wherein the actuatable bayonet locking means is totally with the door.

9. The method as claimed in claim 8 wherein motor means actuates the bayonet locking means and the motor actuation is controlled electronically from outside the stationary cabinet and door.

* * * * *